US012674605B2

(12) United States Patent
Havard, Jr.

(10) Patent No.: US 12,674,605 B2
(45) Date of Patent: Jul. 7, 2026

(54) SYSTEMS AND METHODS FOR HEAT PUMP SYSTEMS WITH REDIRECTED OUTFLOW FOR IMPROVED EFFICIENCY

(71) Applicant: Rheem Manufacturing Company, Atlanta, GA (US)

(72) Inventor: Harold Gene Havard, Jr., Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 176 days.

(21) Appl. No.: 18/444,081

(22) Filed: Feb. 16, 2024

(65) Prior Publication Data

US 2024/0302083 A1 Sep. 12, 2024

Related U.S. Application Data

(60) Provisional application No. 63/450,315, filed on Mar. 6, 2023.

(51) Int. Cl.

| | |
|---|---|
| ***F25B 30/02*** | (2006.01) |
| ***F25B 41/26*** | (2021.01) |
| ***F25B 49/02*** | (2006.01) |

(52) U.S. Cl.

CPC ..... *F25B 30/02* (2013.01); *F25B 41/26* (2021.01); *F25B 49/02* (2013.01)

(58) Field of Classification Search

CPC ..... F24F 1/028; F24F 1/027; F24F 2221/16; F24F 1/03; F24F 1/031

See application file for complete search history.

(56) References Cited

U.S. PATENT DOCUMENTS

| | | | | |
|---|---|---|---|---|
| 6,698,219 | B2 * | 3/2004 | Sekhar | F24F 11/46 454/236 |
| 2023/0039363 | A1 * | 2/2023 | Harkin | F24F 13/24 |
| 2023/0296296 | A1 * | 9/2023 | Taras | F24F 13/10 62/151 |
| 2023/0349581 | A1 * | 11/2023 | Hjortland | F25B 41/20 |

FOREIGN PATENT DOCUMENTS

| | | | | |
|---|---|---|---|---|
| EP | 3093571 | A1 * | 11/2016 | F24F 12/003 |

* cited by examiner

*Primary Examiner* — Lionel Nouketcha

(74) *Attorney, Agent, or Firm* — Eversheds Sutherland (US) LLP

(57) ABSTRACT

Systems and methods for improving efficiency in a heat pump system using redirected outflow air are provided. The heat pump may direct conditioned air, e.g., cooled air, into a duct for circulation throughout a room or building and may receive via ducting airflow from the room and/or building. The airflow received from the building may be closer in temperature to the air directed into the building than the air in the exterior environment. The air received from the building may be redirected using a conduit to condenser or evaporator coils for heat exchange with the coils. Using the air from the building instead of the air from the exterior environment may provide for more efficient heat exchange with the coils, e.g., evaporator coils, improving efficiency of the heat pump.

20 Claims, 6 Drawing Sheets

SYSTEMS AND METHODS FOR HEAT PUMP SYSTEMS WITH REDIRECTED OUTFLOW FOR IMPROVED EFFICIENCY

CROSS-REFERENCE TO RELATED APPLICATION

This application claims priority to U.S. Provisional Patent Application Ser. No. 63/450,315, filed Mar. 6, 2023, the entire contents of which are incorporated herein by reference.

TECHNICAL FIELD

The present disclosure is generally in the field of heat pumps. For example, systems and methods are provided herein for heat pumps with redirected airflow and improved efficiency.

BACKGROUND

Heat pump systems including cooling systems (e.g., air conditioning systems) heat and cool fluids for residential and commercial use. Heat pump systems can selectively provide cooling to a given space (e.g., indoor space) and often times can heat the same space. For example, a heat pump system may include condenser coils and evaporator coils. When a reversing valve is in a first direction, the heat pump system may have the evaporator coil (e.g., situated within a residential or commercial building) heat the indoor space. When desirable, the reversing valve may be actuated to transition to a second direction to cause the heat pump system to move the fluid in a reverse direction to cause the heat pump system to cool the indoor space.

Heat pump systems are typically positioned in outdoor environments easily accessible to airflow but often times in harsh environment conditions. For example, heat pump systems may be rooftop systems that are positioned on a roof of a building. Roof top heat pump systems have evolved over time to adapt to harsh environmental conditions and typically feature a hood and even mesh coverings on the inlet to the heat pump system to prevent foreign objects and unwanted substances and fluids from entering the heat pump system.

As heat pump systems are often positioned outdoors or at least partly outdoors, frequently the temperature inside of a building in which air is conditioned by the heat pump system is significantly different than the temperature of the outdoor environment. For example, a heat pump rooftop unit may be in cool mode and may cause an indoor environment to be 72 degrees Fahrenheit, while the outdoor environment is 100 degrees Fahrenheit. It may be challenging for the heat pump system to efficiently achieve and maintain a desired temperature when the outdoor temperature is significantly different than the indoor temperature.

Accordingly, there is a need for improved methods and systems for efficiently maintaining an indoor space at a desired temperature when the outdoor temperature is significantly different.

DETAILED DESCRIPTION

Improved heat pump systems have been developed which are capable of improving efficiency of the heat pump system using redirected outflow airflow. The heat pump system may be designed to receive air from an interior of an indoor space. The air in the indoor space may be relatively close to the desired temperature of the indoor space as compared to the temperature outside of the building. For example, the temperature inside the building may be 72 degrees Fahrenheit and the temperature outside may be 100 degrees.

The heat pump system may capture some or all of the outflow airflow from the interior of the building and redirect this airflow to the condenser coil for example. As the temperature of the outflow airflow may be significantly lower than the temperature of the outdoor environment, the condenser coil may be cooled more quickly and efficiently than if only the exterior environment airflow is used.

Figure 1:
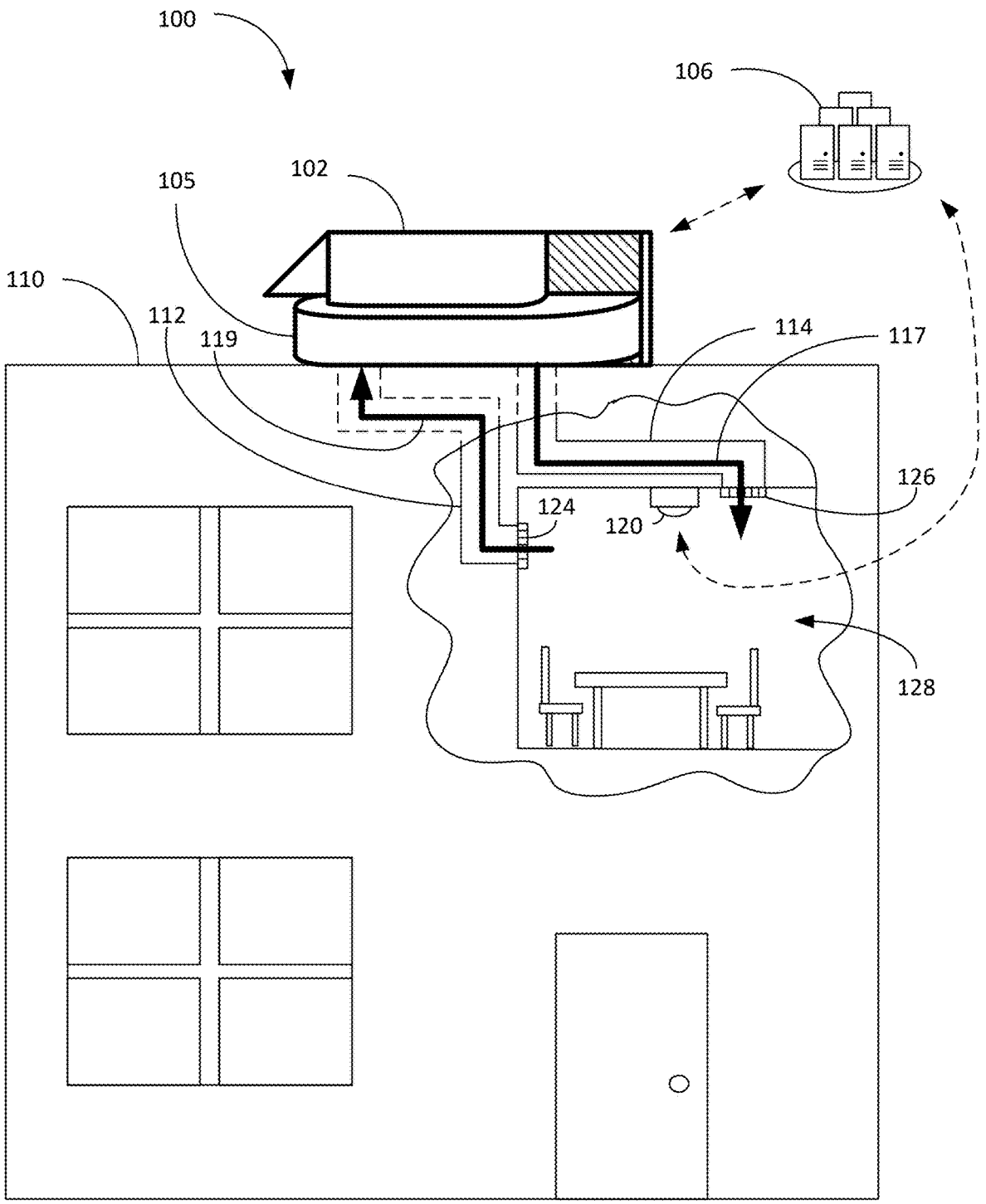
FIG. 1 is a schematic illustration a rooftop heat pump system with a redirecting conduit positioned on the roof of a building in accordance with one or more example embodiments of the disclosure.

Referring now to FIG. 1, a rooftop heat pump system having an airflow redirecting conduit is illustrated positioned upon a rooftop. Specifically, heat pump system 100 may include heat pump 102, controller 106, and, optionally, sensor 120. One or more components of heat pump 102 may be coupled to and/or in communication with, or may incorporate, controller 106. Controller 106 may be a computing device with one or more processors and may optionally include a display.

Controller 106 may be a dedicated controller for heat pump 102 or may be a separate computing device such as smart phone, tablet, laptop, desktop computer, or the like. Controller 106 may be responsible for controlling the operation of heat pump 102, including the actuation of one or more valves (e.g., reversing valves) and/or actuation of one or more dampers or vents. Controller 106 may further be responsible for monitoring the performance and operation of heat pump 102.

Controller 106 may communicate with heat pump 102 via any well-known wired or wireless system (e.g., Bluetooth, Bluetooth Low Energy (BLE), near field communication protocol, Wi-Fi, cellular network, etc.). Alternatively, controller 106 may be a standalone device and may communicate with a controller incorporated into heat pump 102 (e.g., via any well-known wired or wireless communication).

Heat pump 102 may be designed to heat or cool a space (e.g., indoor residential or commercial space). As shown in FIG. 1, heat pump 102 may be a roof top heat pump designed to be installed on the roof of building 110. Building 110 may be a residential or commercial building that may include one or more interior spaces (e.g., interior space 128). Heat pump 102 may be connected to the interior spaces via air ducting that may extend throughout building 110.

As shown in FIG. 1, heat pump 102 may condition air to create first airflow 117, which may be air that has been cooled to a desired temperature. For example, controller may cause heat pump 102 to cool air to 72 degrees Fahrenheit. In other non-limiting examples, controller may cause heat pump 102 to cool air between, 80-85 degrees, 75-80 degrees, 70-75 degrees, 65-70, and/or 60-70 degrees Fahrenheit. First airflow 117 may be directed to interior space 128 via inflow duct/first inlet 114, which may be any type of well-known heating and/or cooling ducting for a residential or commercial building. Inflow duct/first inlet 114 may connect to heat pump 102 on one end and may terminate at outlet duct/first outlet 126, which may eject air into interior space 128.

Interior space may also include outflow duct/second inlet 124, which may receive airflow in interior space 128 and deliver air from interior space 128 back to heat pump 102 via outflow duct/second outlet 112. For example, second airflow 119 may include air from interior space 128 that may be directed via outflow duct 112 back to heat pump 102. Heat pump 102 may selectively redirect some or all of second airflow 119 to condenser coils via conduit 105 to cool the condenser coils. As air from interior space 128 may be cooler than air from the exterior environment (e.g., outside of building 110), air from interior space 128 may cool the condenser coils more efficiently than air from the exterior environment.

Interior space 128 may also include sensor 120. Sensor 120 may be any type of sensor that monitors the air in interior space 128. For example, sensor 120 may be a temperature sensor (e.g., thermometer) and/or may be a carbon dioxide sensor. For example, sensor 106 may determine a carbon dioxide amount, level and/or percentage in the air in interior space 128 and/or any other information (e.g., temperature information). It is understood that sensor 120 may be any other type of sensor for analyzing characteristics of the air.

Sensor 120 may wirelessly communicate with controller 106 to send a message or signal to controller 106 representative of information from sensor 120 (e.g., the carbon dioxide amount, level, percentage and/or the temperature). It is understood that more than one sensor 120 may be included in interior space 128 and/or other interior spaces throughout building 110.

Controller 106 may determine based on the signal and/or other information from sensor 120 that the air in interior space 128 has a carbon dioxide level, percentage, or amount that is unacceptable (e.g., above a threshold level). In response, controller may cause heat pump to eject second airflow 119 into the exterior environment and/or into conduit 105. As conduit 105 does not recirculate the airflow from the interior environment back into the building, the high levels of carbon dioxide in conduit 105 will not enter inflow duct/first inlet 114 and reenter interior space 128.

Figure 2:
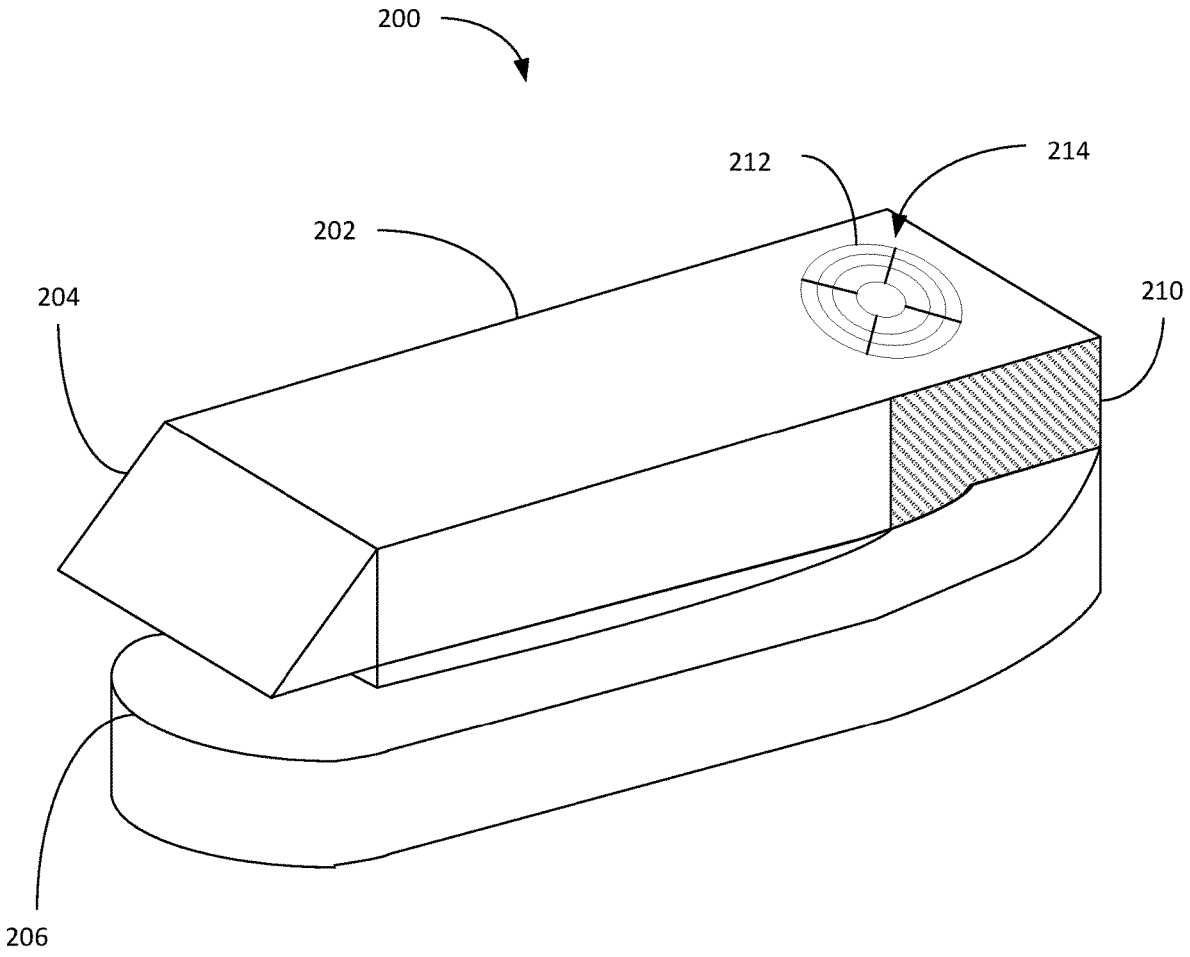
FIG. 2 is a perspective view of rooftop a heat pump system with a redirecting conduit in accordance with one or more example embodiments of the disclosure.

Referring now to FIG. 2, a heat pump with redirected outflow airflow to a condenser coil is illustrated. Specifically, heat pump 200 is illustrated and may be a rooftop heat pump. Heat pump 200 may include evaporator coils, condenser coils, an expansion device (e.g., expansion valve, orifice, or capillary tube) and a compressor connecting the evaporator coils and condenser coils. Heat pump 200 may also include a reversing valve for reversing the flow of fluid to transition from heat mode to cool mode and vice versa.

Heat pump 200 may be designed for installation on the roof or exterior structure of a building and may be connected to the air ducting extending throughout the building, such that at least one inflow duct and one outflow duct in the building is connected to heat pump 200. As shown in FIG. 2, heat pump 200 may include housing 202, redirection conduit 206, condenser inlet 210, fan 212, and outlet 214. In one example, heat pump 200 may be the same or similar to heat pump 300 of FIG. 3.

Housing 202 may house the components of heat pump 200 including, without limitation, condenser coils, evaporator coils, a compressor, and an expansion device. Housing 202 may be generally rectangular in shape and may be water resistant and/or designed to withstand harsh weather conditions. In one example, housing 202 may be made from sheet metal or other robust material (e.g., plastic). Housing 202 may be secured to a roof top of a building via a threaded connection, bolts, welding, and the like.

Housing 202 may be connected to hood 204, which may be welded, adhered, secured by threaded connection or any other well-known technique to housing 202. Alternatively, hood 204 may be integral with housing 202. Hood 204 may extend from the top of housing 202 and may be sloped downward such that any foreign object or substance that lands on hood 204 is guided downward by gravity. Hood 204 may extend over an inlet and an outlet near the end of housing 202 and may prevent foreign objects and/or substances (e.g., snow, water, leaves, etc.) from entering housing 202.

Conduit 206 may have an inlet and an outlet and may redirect some or all of the airflow from the outlet of heat pump 200. For example, an inlet of conduit 206 may be connected to an outlet of housing 200 and may redirect some or all of the airflow from the outlet to inlet 210 of housing 202. Inlet 210 may be positioned at the rear of housing 202 near coils (e.g., condenser coils). Inlet 210 may include a grating and/or mesh to permit exterior air to enter but prevent foreign objects and substances from entering.

Inlet 210 may be positioned near the coils used for heat exchange of fluid within the coils but not used for conditioning air intended to be circulated throughout a building. As shown in FIG. 2, conduit 206 may direct air from the outlet of housing 202 (e.g., originating from an interior of the building) to inlet 210. In one example, air from the outlet of housing 202 may be lower in temperature than air from the environment exterior to housing 202. The cooler air may facilitate efficient heat exchange at the coils near inlet 210.

Fan 212 may be positioned near the rear and top of housing 202 and may cause air to flow from inlet 210 to outlet 214. For example, fan 212 may cause air to flow from inlet 210, across the condenser coils positioned near the rear of heat pump 200, and out of outlet 214. Fan 212 may be incorporated in outlet 214 and/or may be positioned within the rear of housing 202. While a portion of inlet 210 is shown exposed to the environment exterior to heat pump 202, it is understood that conduit 206 may cover all of inlet 210 such that no air from the exterior environment enters heat pump 200. Alternatively, it is understood that conduit 206 may be directed at inlet 210 but may terminate prior to inlet 210.

Figure 3:
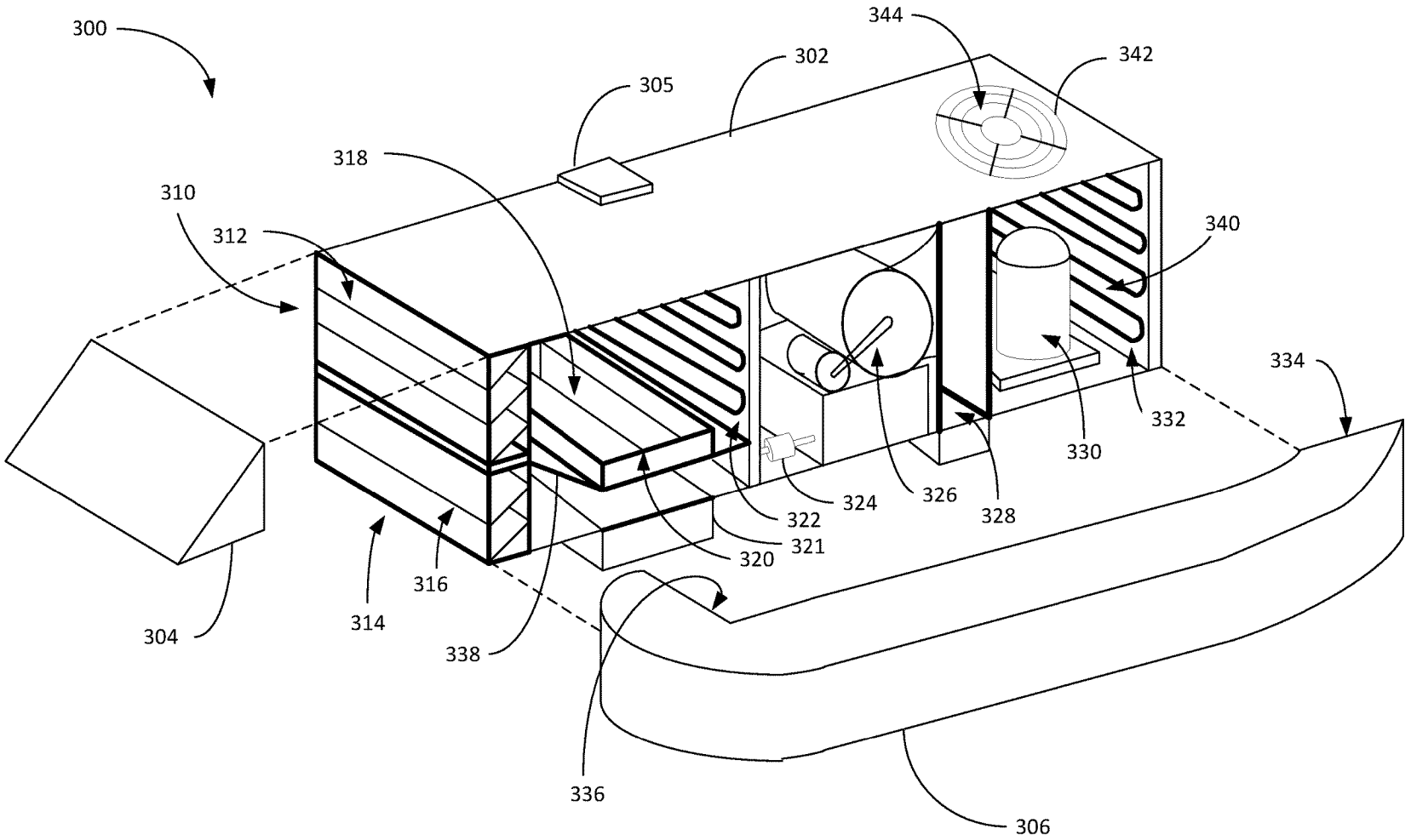
FIG. 3 is a perspective cutaway view of a rooftop heat pump system with a redirecting conduit in accordance with one or more example embodiments of the disclosure.

Heat pump 300 may include hood 304, Referring now to FIG. 3, heat pump 300 is illustrated. It is understood that heat pump 300 may be the same or similar to heat pump 102 of FIG. 1. Heat pump 300 may include housing 302 which may be the same or similar to housing 202 of FIG. 2. Housing 302 may include first inlet 310 at one end of housing 302, which may permit air from the environment exterior to heat pump 300 to enter housing 302. First inlet 310 may be opened and closed using dampers 312. It is understood that dampers 312 may be gradually adjusted to be partially opened/closed.

Heat pump 300 may optionally include controller 305 which may be incorporated into heat pump 300 and may include a processor and optionally a display. Controller 305 may communicate with a remote device such as controller 106 of FIG. 1. Controller 305 and/or a remote controller may cause dampers 312 to actuate to transition between opened and closed and may further be used to control any other dampers, valves, vents, motors, blowers, compressors, fans, and the like, of heat pump 300.

which may be the same as or similar to hood 204 of FIG. 2. Hood 304 may slope downward to directed any foreign substance or object to the ground. Hood 304 may protect first inlet 310 and/or first outlet 314 from any foreign objects and/or substance (e.g., water, rain, leaves, animals, etc.). In one example, hood 304 may be made from sheet metal or any other material such as plastic.

Housing 302 may also include first outlet 314 at the same end of heat pump 300 as first inlet 310. First outlet 314 may optionally include dampers 316 that may be actuated to transition from an open position to a closed position and/or any position therebetween. Dampers 316 may be actuated by controller 305 and/or may be remotely actuated. As shown in FIG. 3, inlet 336 of conduit 306 may connect to part or all of first outlet 314 such that airflow exiting housing 302 via first outlet 314 may be captured and redirected by conduit 306. While conduit is illustrated in FIG. 3 as an exterior conduit, it is understood that conduit 306 may be an interior conduit, incorporated into housing 302.

Conduit 306 may be tubular in shape and/or may have a rectangular cross-section along portions of conduit 306. In one example, conduit 306 may be made of sheet-metal, though it is understood that conduit 306 may be made from any other material. Conduit 306 may include outlet 334 which may be connected to third inlet 340 of housing 302 that may be situated near coils 332, which in cool mode may be condenser coils. It is understood that outlet 334 may connect to all or of a portion of third inlet 340 near coils 332. Alternatively, outlet 334 may be positioned near third inlet 340 of housing 302, but may not completely connect with third inlet 340 such that some or all of outlet 334 may terminate before third inlet 340.

Housing 302 may include divider 338, which may divide the airflow between first inlet 310 and first outlet 314. Divider 338 may extend from first inlet 310 and first outlet 314 to coils 322, which may be several coils through which fluid, such as refrigerant, may circulate. Divider 338 may include duct 320 which may include damper 318 which may be transitioned between opened and closed positions and therebetween (e.g., using controller 305 and/or a remote controller). Duct 320 may receive air from duct/second inlet 321 which may be connected to ducting of the building.

When duct 320 is open, air from the interior space (e.g., an indoor volume of air) may enter coils 332 and ultimately be recirculated into the interior space. Also, when damper 318 is open, air from the interior space will also exit first outlet 314. When damper 318 is closed, air from the interior space may be forced out of first outlet 314 and will not flow through coils 322 to be recirculated into the building. As inlet 336 of conduit 306 is connected or positioned near first outlet 314, some or all of the airflow exiting first outlet 314 may enter conduit 306.

Airflow from first inlet 310 and/or duct 320 may traverse coils 322 and otherwise flow across and through coils 322. Coils 322 may be several coils through which the fluid circulates for heat exchange with airflow from first inlet 310 and/or duct 320. For example, in cool mode, coils 322 may be evaporator coils that may cause the air flowing across coils 322 to cool to a lower temperature, thereby heating the fluid in coils 322.

Upon flowing across coils 322 and exchanging heat with coils 322, the airflow may be directed towards second outlet 328. Specifically blower 326 may cause air to move from coils 322 to second outlet 328. Second outlet 328 may be connected to ducting inside of the building that may deliver the conditioned air (e.g., cool air) through the building. Blower 326 may be any type of well-known blower and/or fan and may cause airflow into second outlet 328.

Coils 322 may be connected to coils 332, which may be positioned near the rear of housing 302. Coils 322 may similarly be several coils that circulate the fluid for heat exchange. In one example, in cool mode, coils 322 may be an evaporator. Coils 322 may connect at one end to one end of coils 332 with compressor 330 positioned therebetween. Coils 322 may connect at another end to another end of coils 332 with expansion device 324 positioned therebetween. Expansion device 325 may be an expansion valve, orifice, or capillary tube, for example.

Compressor 330 may compress the fluid circulating through coils 322 and 332 resulting in a heated vapor. Expansion device 324 may decrease the pressure applied to the fluid, thereby decreasing the pressure applied to the fluid and thus decreasing the temperature of the fluid. Compressor 330 and expansion device 324 may be any well-known compressor or expansion device, in the field of heat pumps. A reversing valve (not shown) may also be included housing 302 to cause the fluid to reverse direction to transition between heat mode and cool mode of heat pump 300. Fan 344, which may be one or more fans, may be positioned near coils 332 and may cause airflow (e.g., an outdoor volume of air) from third inlet 340 over coils 332 to facilitate heat exchange. After flowing across coils 332, the air from third inlet 340 may exit third outlet 342.

It is understood that one or more outlets and/or inlets of heat pump 300 may include a mesh or grated covering to obstruct foreign objects or substances from entering housing 302. It is further understood that heat pump 300 may include one or more air filters for removing harmful particles from the airflow entering the building. For example, one or more air filters may be positioned between first inlet 310 and/or second inlet 321 and second outlet 328.

It is understood that one or more outlets and/or inlets of heat pump 300 may include a mesh or grated covering to obstruct foreign objects or substances from entering housing 302. It is further understood that heat pump 300 may include one or more air filters for removing harmful particles from the airflow entering the building. For example, one or more air filters may be positioned between inlet 310 and/or inlet 321 and outlet 328.

Figure 4:
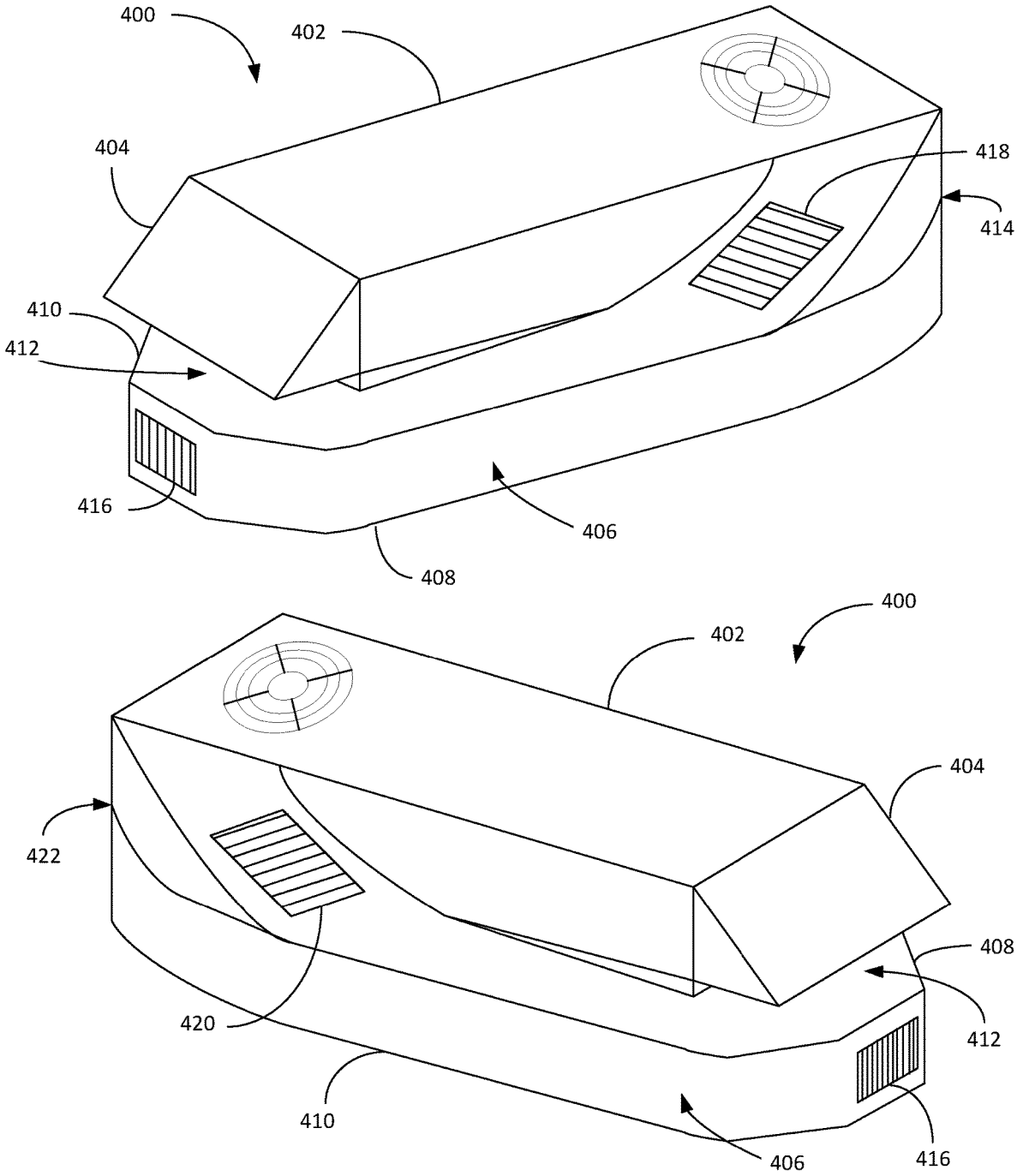
FIG. 4 is a perspective view of a rooftop heat pump system with a dual sided redirecting conduit in accordance with one or more example embodiments of the disclosure.

Referring now to FIG. 4, heat pump 400 is illustrated from a right side and a left side. Heat pump 400 may be the same or similar to heat pump 300 of FIG. 3, but may include conduit 406, which may be different from conduit 306 of FIG. 3. Like heat pump 300 of FIG. 3, heat pump 400 of FIG. 4 may include housing 402 and hood 404, which may be the same as or similar to housing 302 and hood 304 of FIG. 3. Further, heat pump 400 may have the same or similar components as heat pump 300 of FIG. 3.

Heat pump 400 may further include conduit 406, which may include inlet region 412, right conduit 408, and left conduit 410. Inlet region 412 may connect to the outlet of heat pump 400 such that the entire airflow exiting the outlet in the front region of heat pump 400 may be captured by conduit 406. Conduit 406 may be tubular in shape and may have a rectangular cross-section along some portions of conduit 406.

Inlet region 412 may include inlet 416 that may be actuated to open and close inlet 416 (e.g., via a controller). Inlet 416 may be actuated, for example, if it is determined by a carbon dioxide sensor that the carbon dioxide level or percentage in an interior space is too high. Alternatively, or additionally, it may be desirable to receive airflow from the exterior environment (e.g., for improved efficiency). From inlet region 412, conduit 412 may branch off into right conduit 408 and left conduit 410.

Right conduit 408 may extend along the length of housing 402 and may terminate at outlet region 414. Outlet region 414 may cover the entirety of a rear inlet of housing 402 designed to provide airflow to coils positioned at the rear of housing 402 (e.g., condenser coils). Alternatively, outlet region 414 may be sized to cover and/or connect to only a portion of the inlet at the rear of housing 402. Alternatively, or additionally, outlet region 414 may not connect directly to the inlet at the rear of housing 402, but instead may terminate or at least partially terminate before reaching the inlet.

Left conduit 410 may extend along the length of housing 402 and may terminate at outlet region 422. Outlet region 422 may expand to cover the entirety of a rear inlet of housing 402 designed to provide airflow to coils positioned at the rear of housing 402 (e.g., condenser coils). Alternatively, outlet region 422 may be sized to cover and/or connect only a portion of the inlet at the rear of housing 402. Alternatively, or additionally, outlet region 422 may not connect directly to the inlet at the rear of housing 402, but instead may terminate or at least partially terminate before reaching the inlet.

Conduit 406 may include inlet 418 and conduit 408 may include inlet 420. Inlet 418 and inlet 420 may be independently actuated (e.g., by a controller) to transition from a closed position to an open position. Inlet 418 and/or inlet 420 may be actuated, for example, if it is determined by a carbon dioxide sensor that the carbon dioxide level or percentage in an interior space is too high. Alternatively, or additionally, it may be desirable to receive airflow from the exterior environment (e.g., for improved efficiency).

Figure 5:
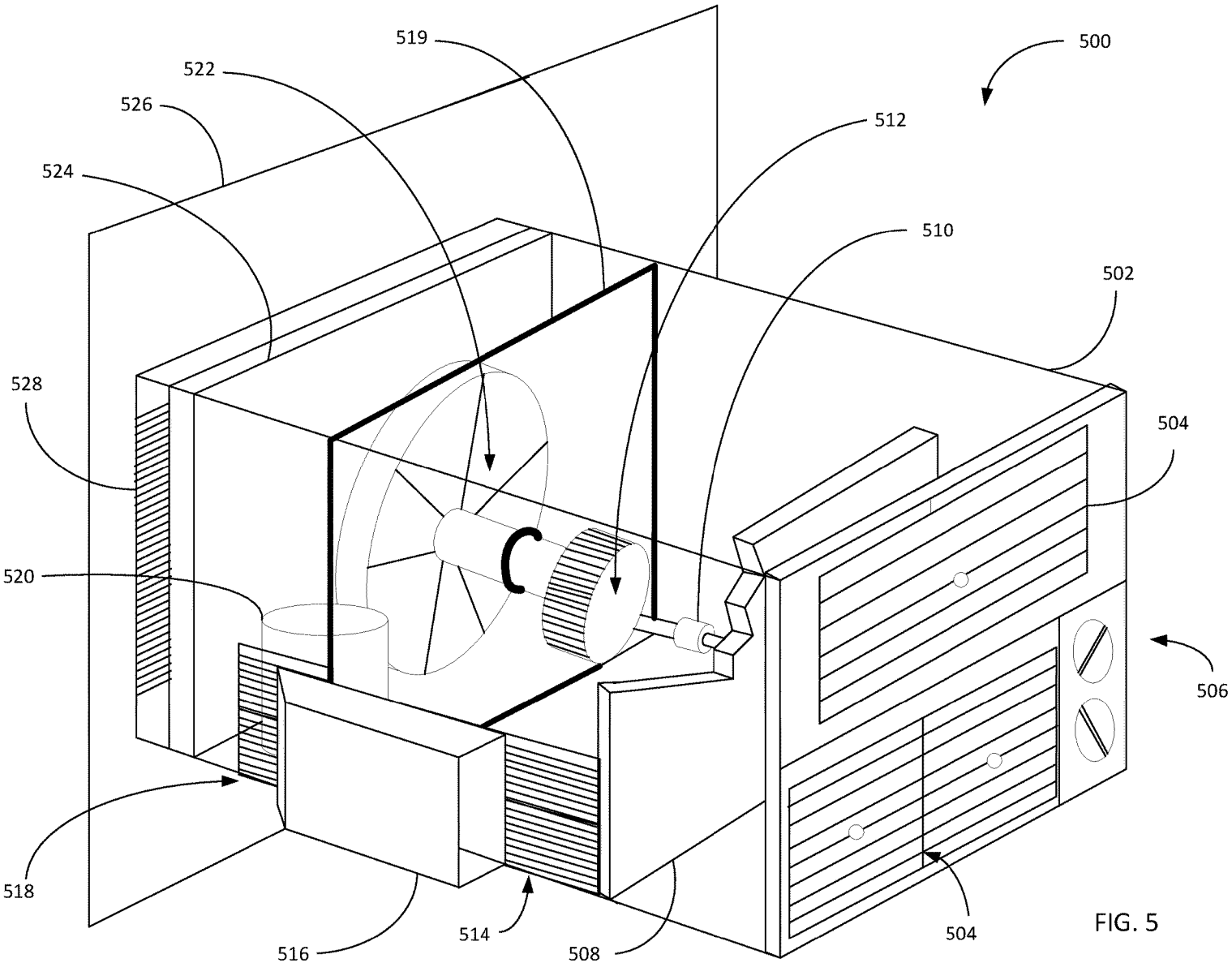
FIG. 5 is a perspective cutaway view of a window cooling system in accordance with one or more example embodiments of the disclosure.

Referring now to FIG. 5, a heat pump (e.g., cooling system) with redirected outflow airflow is illustrated. Specifically, heat pump 500 is illustrated and may be designed to be installed in a window opening (e.g., window opening 526 and/or wall opening of an indoor space. Heat pump 500 may be used to cool an indoor space such as a room. It is understood that heat pump 500 may optionally include a reversing valve and may be designed to transition from a cool mode to a heat mode to also heat the indoor space.

As shown in FIG. 5, heat pump 500 may include housing 502, which may be rectangular in shape. In one example, the housing may be made of metal, plastic, and/or alloy or may be made from any other well-known materials. Heat pump 500 may include outlets 504 at the front of heat pump 500. Outlets 504 may eject conditioned (e.g., cooled or heated air) from heat pump 500. Outlets 504 may be directional and may even include one or more outlets that may be directed in different directions. Controller 506 may also be integrated into heat pump 500 and may include one or more displays or knobs. Controller 506 may control the operation of heat pump 500.

Air from the interior space (e.g., room of a building) may enter inlet 514, which may be grated or have a mesh to prevent foreign objects or substances from entering housing 502. While inlet 514 is illustrated on the side of heat pump 500, inlet 514 may alternatively be positioned at a different location on heat pump 500. For example, inlet 514 may be positioned on the front of heat pump 500. In one example, both inlet 514 and outlet 504 may be positioned on the front of heat pump 500. As shown in FIG. 5, inlet 514 may be the lower two vents on the front of heat pump 500 and outlet 504 may be the upper vent.

Air entering inlet 514 may be redirected by blower 512 through coils 508 and ultimately out of outlet 504. Blower 512 may be any well-known blower or fan in heat pump systems. Coils 508 may be several coils through which a fluid such as a refrigerant may circulate. Air flowing over the coils may exchange heat with the fluid in the coils, causing the fluid to warm and the air to cool in cool mode.

Coils 508 may be connected at one end to one end of coils 524 with compressor 520 positioned therebetween. Coils 508 may be connected at another end to another end of coils 524 with expansion device 510 positioned therebetween. Expansion device 510 may be an expansion valve, orifice, or capillary tube, for example. Coils 524 may be the same or similar to coils 508. Compressor 520 may compress the fluid circulating through coils 508 and 524, resulting in a heated vapor. Expansion device 510 may decrease the pressure applied to the fluid, thereby decreasing the pressure to the fluid and decreasing the temperature of the fluid. Compressor 520 and expansion device 510 may be any well-known compressor or expansion device in the field of heat pumps.

Divider 519 may thermally divide and/or isolate coils 508 from coils 524. Blower 512 and coils 508 may be on the same side of divider 519 and fan 522 and coils 524 may be on the other side of divider 519. Fan 522 may cause air to enter inlet 518 and cause the air to flow across coils 524. In a cool mode, coils 508 may be evaporator coils and coils 524 may be condenser coils. Upon flowing across and/or through coils 524, air may exit outlet 528 which may be on a back region of housing 502, for example.

Inlet 518 may be positioned on an exterior side of window opening 526 and inlet 514 may be positioned on an interior side of window opening 526. Accordingly, air entering inlet 518 may be air from the exterior environment outside of the building in which heat pump 500 is installed. Heat pump 500 may include conduit 516 which may include an inlet and an outlet and which may redirect interior air from the interior side of window opening to inlet 518 on the exterior side of window opening 526, such that interior airflow may flow across coils 524. Conduit 516 may be rectangular in shape and/or may take any other shape. Conduit 516 may be sheet metal, plastic, or any other material. Conduit 516 may alternatively be incorporated into housing 502. It is understood that conduit 516 may cover all or some of inlet 518. It is further understood that conduit 516 may direct air towards inlet but may terminate before reaching inlet 518.

It may be desirable to cause airflow from the interior space to flow across coils 524. As air from inside window opening 526 may be cooler than air from the exterior environment (e.g., outside of the window and/or building), air from the interior space may cool the condenser coils more efficiently than air from the exterior environment. Similar efficiencies may be achieved in heat mode using interior air for heat exchange with coils 524 as evaporator coils.

It is understood that inlets similar to inlet 514 and inlet 518 may be integrated into the right side of heat pump 500 as well. It is further understood that greater or fewer inlets and outlets may be positioned on heat pump 500 and the position and size of one or more inlet and/or outlet may be different than that illustrated in FIG. 5. Controller 506 may be in communication with one or more other controllers that may also be in communication with one or more sensors (e.g., temperature sensors and/or carbon dioxide sensors).

Figure 6:
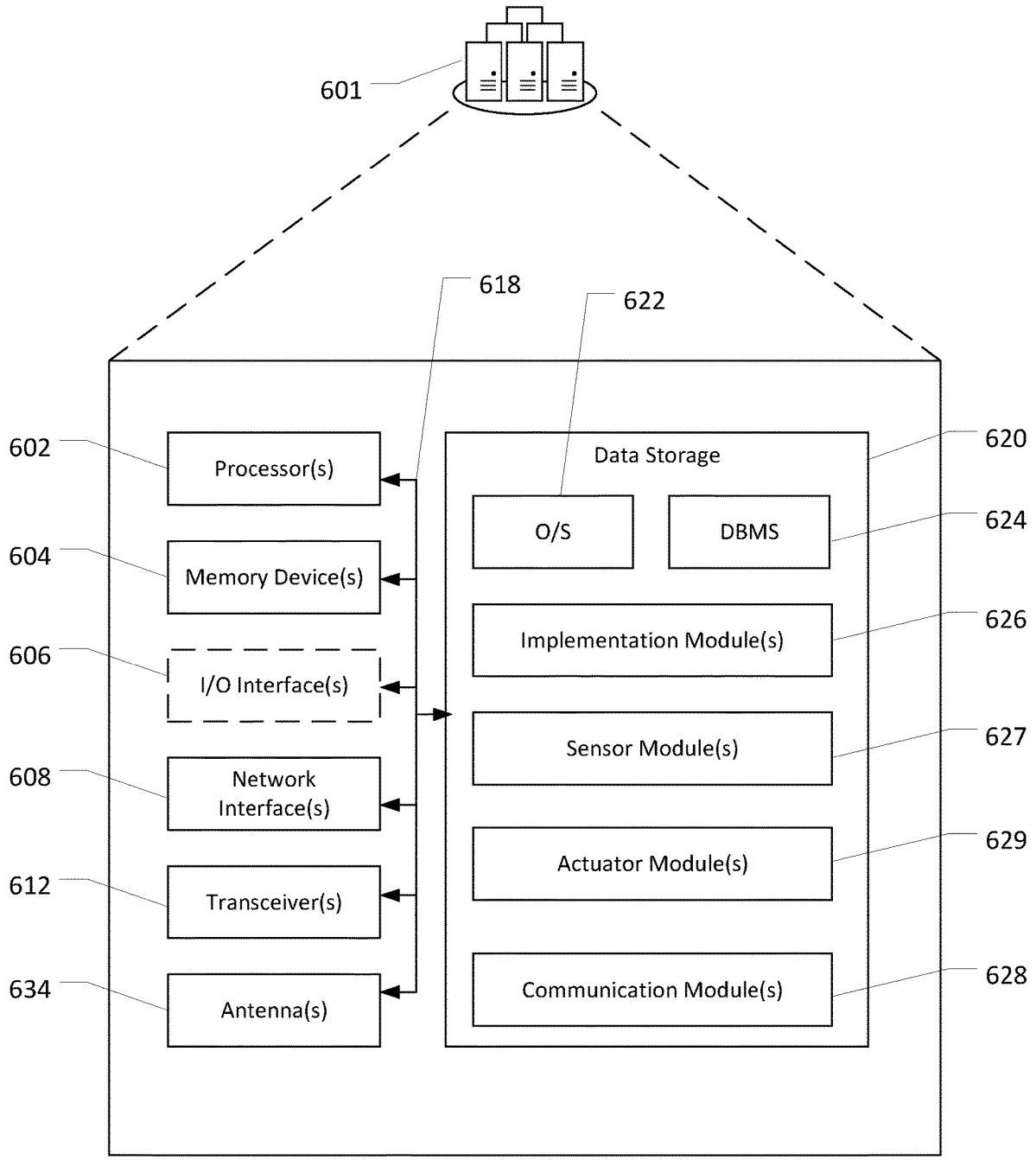
FIG. 6 is a schematic block diagram of a heat pump system in accordance with one or more example embodiments of the disclosure.

FIG. 6 is a schematic block diagram of an illustrative controller 600, which may be incorporated into a heat pump and/or communicate with a heat pump, in accordance with one or more example embodiments of the disclosure. Controller 600 may be the same or similar to controller 106 of FIG. 1, controller 305 of FIG. 3, and/or controller 506 of FIG. 5 or otherwise one or more of the controllers and heat pumps of FIGS. 1-5.

Controller 600 may be configured to communicate with one or more servers, mobile devices, user devices, other systems, or the like. Controller 600 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks.

In an illustrative configuration, controller 600 may include one or more processors 602, one or more memory devices 604 (also referred to herein as memory 604), one or more input/output (I/O) interface(s) 606, one or more network interface(s) 608, one or more transceiver(s) 612, one or more antenna(s) 634, and data storage 620. The controller 600 may further include one or more bus(es) 618 that functionally couple various components of the controller 600.

The bus(es) 618 may include at least one of a system bus, a memory bus, an address bus, or a message bus, and may permit exchange of information (e.g., data (including computer-executable code), signaling, etc.) between various components of the controller 600. The bus(es) 618 may include, without limitation, a memory bus or a memory controller, a peripheral bus, an accelerated graphics port, and so forth. The bus(es) 618 may be associated with any suitable bus architecture including.

The memory 604 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In various implementations, the memory 604 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth.

The data storage 620 may include removable storage and/or non-removable storage including, but not limited to, magnetic storage, optical disk storage, and/or tape storage. The data storage 620 may provide non-volatile storage of computer-executable instructions and other data. The memory 604 and the data storage 620, removable and/or non-removable, are examples of computer-readable storage media (CRSM) as that term is used herein. The data storage 620 may store computer-executable code, instructions, or the like that may be loadable into the memory 604 and executable by the processor(s) 602 to cause the processor(s) 602 to perform or initiate various operations. The data storage 620 may additionally store data that may be copied to memory 604 for use by the processor(s) 602 during the execution of the computer-executable instructions. Moreover, output data generated as a result of execution of the computer-executable instructions by the processor(s) 602 may be stored initially in memory 604, and may ultimately be copied to data storage 620 for non-volatile storage.

The data storage 620 may store one or more operating systems (O/S) 622; one or more optional database management systems (DBMS) 624; and one or more program module(s), applications, engines, computer-executable code, scripts, or the like such as, for example, one or more implementation modules 626, sensor modules 627, actuator modules 629, and one or more communication modules 628. Some or all of these modules may be sub-modules. Any of the components depicted as being stored in data storage 620 may include any combination of software, firmware, and/or hardware. The software and/or firmware may include computer-executable code, instructions, or the like that may be loaded into the memory 604 for execution by one or more of the processor(s) 602. Any of the components depicted as being stored in data storage 620 may support functionality described in reference to correspondingly named components earlier in this disclosure.

Referring now to other illustrative components depicted as being stored in the data storage 620, the O/S 622 may be loaded from the data storage 620 into the memory 604 and may provide an interface between other application software executing on the controller 600 and hardware resources of the controller 600. More specifically, the O/S 622 may include a set of computer-executable instructions for managing hardware resources of the controller 600 and for providing common services to other application programs (e.g., managing memory allocation among various application programs). In certain example embodiments, the O/S 622 may control execution of the other program module(s) to for content rendering. The O/S 622 may include any operating system now known or which may be developed in the future including, but not limited to, any server operating system, any mainframe operating system, or any other proprietary or non-proprietary operating system.

The optional DBMS 624 may be loaded into the memory 604 and may support functionality for accessing, retrieving, storing, and/or manipulating data stored in the memory 604 and/or data stored in the data storage 620. The DBMS 624 may use any of a variety of database models (e.g., relational model, object model, etc.) and may support any of a variety of query languages. The DBMS 624 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like.

The optional input/output (I/O) interface(s) 606 may facilitate the receipt of input information by the controller 600 from one or more I/O devices as well as the output of information from the controller 600 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; and so forth. Any of these components may be integrated into the controller 600 or may be separate.

The controller 600 may further include one or more network interface(s) 608 via which the controller 600 may communicate with any of a variety of other systems, platforms, networks, devices, and so forth. The network interface(s) 608 may enable communication, for example, with one or more wireless routers, one or more host servers, one or more web servers, and the like via one or more of networks.

The antenna(s) 634 may include any suitable type of antenna depending, for example, on the communications protocols used to transmit or receive signals via the antenna(s) 634. Non-limiting examples of suitable antennas may include directional antennas, non-directional antennas, dipole antennas, folded dipole antennas, patch antennas, multiple-input multiple-output (MIMO) antennas, or the like. The antenna(s) 634 may be communicatively coupled to one or more transceivers 612 or radio components to which or from which signals may be transmitted or received. Antenna(s) 634 may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals including BLE signals, a Near Field Communication (NFC) antenna for transmitting or receiving NFC signals, a 900 MHz antenna, and so forth.

The transceiver(s) 612 may include any suitable radio component(s) for, in cooperation with the antenna(s) 634, transmitting or receiving radio frequency (RF) signals in the bandwidth and/or channels corresponding to the communications protocols utilized by the controller 600 to communicate with other devices. The transceiver(s) 612 may include hardware, software, and/or firmware for modulating, transmitting, or receiving-potentially in cooperation with any of antenna(s) 634—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 612 may further include hardware, firmware, or software for receiving GNSS signals. The transceiver(s) 612 may include any known receiver and baseband suitable for communicating via the communications protocols utilized by the controller 600. The transceiver(s) 612 may further include a low noise amplifier (LNA), additional signal amplifiers, an analog-to-digital (A/D) converter, one or more buffers, a digital baseband, or the like.

Referring now to functionality supported by the various program module(s) depicted in FIG. 6, the implementation module(s) 626 may include computer-executable instructions, code, or the like that responsive to execution by one or more of the processor(s) 602 may perform functions including, but not limited to, overseeing coordination and interaction between one or more modules and computer executable instructions in data storage 620, determining user selected actions and tasks, determining actions associated with user interactions, determining actions associated with user input, initiating commands locally or at remote devices, and the like.

The sensor module(s) 627 may include computer-executable instructions, code, or the like that responsive to execution by one or more of the processor(s) 602 may perform functions including, but not limited to, receiving information, signals or data from one or more sensors and/or processing or analyzing such information, signals and/or data. The transformer module(s) 629 may include computer-executable instructions, code, or the like that responsive to execution by one or more of the processor(s) 602 may cause one or more dampers, vents, ducts, valves, or the like to actuate (e.g., to open or close).

The communication module(s) 628 may include computer-executable instructions, code, or the like that responsive to execution by one or more of the processor(s) 602 may perform functions including, but not limited to, communicating with one or more devices, for example, via wired or wireless communication, communicating with mobile devices, communicating with servers (e.g., remote servers), communicating with remote datastores and/or databases, sending or receiving notifications or commands/directives, communicating with cache memory data, communicating with user devices, and the like.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program module(s), applications, or the like disclosed herein may include one or more software components, including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines, and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

I claim:

1. A heat pump system comprising:

a heat pump comprising:

a housing having a first inlet, a second inlet, a first outlet, and a second outlet;

at least one first coil disposed within the housing and at least one second coil disposed within the housing, configured to receive a fluid, and connected to one another via an expansion device, the at least one first coil configured to exchange heat with an indoor volume of air and the at least one second coil configured to exchange heat with an outdoor volume of air;

a compressor disposed within the housing, configured to heat the fluid, and connected to the at least one first coil and the at least one second coil;

a blower disposed within the housing and configured to cause a first airflow to enter the first inlet, flow across the at least one first coil to cool the first airflow, and exit the first outlet;

a conduit system extending from the housing and configured to receive a second airflow from the second inlet and direct the second airflow to the at least one second coil; and a fan configured to cause the second airflow to flow across the at least one second coil and exit the second outlet, wherein the conduit system is configured to receive the second airflow from the indoor volume of air and to direct the second airflow across the at least one second coil while preventing introduction of outdoor air.

2. The heat pump system of claim 1, wherein the first outlet directs the first airflow into a building, and wherein the second inlet is configured to receive the second airflow from the building.

3. The heat pump system of claim 2, wherein the heat pump is configured to be positioned on a roof of the building.

4. The heat pump system of claim 1, wherein the heat pump further comprises a third outlet configured to direct at least a portion of the second airflow outside of the housing.

5. The heat pump system of claim 1, wherein the heat pump further comprises a third inlet configured to direct a third airflow to the at least one second coil.

6. The heat pump system of claim 1, wherein the conduit is comprised of sheet metal and extends beyond the housing.

7. The heat pump system of claim 1, wherein the conduit includes a damper configured to transition from an open position to a closed position, and wherein the damper is configured to permit a third airflow to enter the conduit.

8. The heat pump system of claim 1, wherein the second inlet includes a damper configured to transition from an open position to a closed position to close the second inlet.

9. The heat pump system of claim 8, further comprising:

a sensor configured to determine a sensor value corresponding to the second airflow;

a controller configured to access memory and execute the computer-executable instructions to:

receive a signal from the sensor, the signal indicative of the sensor value;

cause the damper to transition from the open position to the closed position based on the sensor value.

10. The heat pump system of claim 8, wherein the sensor value corresponds to a carbon dioxide value.

11. The heat pump system of claim 1, wherein the fluid is a refrigerant, the at least one first coil is configured to heat the refrigerant, and the at least one second coil is configured to heat the refrigerant.

12. The heat pump system of claim 1, wherein the heat pump further comprises a hood connected to the housing and configured to cover at least a portion of the first inlet.

13. The heat pump system of claim 1, wherein an air filter is disposed within the housing and positioned between the first inlet and the first outlet.

14. The heat pump system of claim 1, wherein the heat pump further comprises a reversing valve configured to transition between a first position and a second position, the first position configured to permit the fluid to flow only in a first direction and the second position configured to permit the fluid to flow only in a second direction.

15. A cooling system configured to be positioned in a window, the cooling system comprising:

a housing having a first inlet, a second inlet, a first outlet, and a second outlet;

at least one first coil disposed within the housing and at least one second coil, each disposed within the housing, configured to receive a fluid, and connected to one another via an expansion device, the at least one first coil configured to be an evaporator and the at least one second coil configured to be a condenser;

a compressor disposed within the housing, configured to compress the fluid, and connected to the at least one first coil and the at least one second coil;

a blower disposed within the housing and configured to cause a first airflow to enter the first inlet, flow across the at least one first coil to cool the first airflow, and exit the first outlet;

a conduit having a conduit inlet on an interior side of the window and a conduit outlet on an exterior side of the window, the conduit configured to receive a first airflow from the conduit inlet and direct the second airflow to the at least one second coil via the second inlet; and a fan configured to cause the second airflow to flow across the at least one second coil and exit the second outlet, wherein the conduit system is configured to receive the second airflow exclusively from the indoor volume of air and to direct the second airflow across the at least one second coil while preventing introduction of outdoor air.

16. The cooling system of claim 15, further comprising a divider configured to thermally divide the at least one first coil from the at least one second coil.

17. The cooling system of claim 15, wherein the second inlet is on the same side of the divider as the at least one second coil.

18. The cooling system of claim 15, wherein the first inlet and first outlet are configured to be positioned on an interior side of the window and the second inlet and second outlet are configured to be positioned on an exterior side of the window.

19. The cooling system of claim 15, further comprising an air filter is disposed within the housing and positioned between the first inlet and the first outlet.

20. The cooling system of claim 15, wherein the conduit is comprised of sheet metal or plastic.

* * * * *